US006067883A

United States Patent [19]

Cote et al.

[11] Patent Number: 6,067,883

[45] Date of Patent: May 30, 2000

[54] METHOD AND APPARATUS FOR PROVIDING POSITIVE CONTROL OF A PRINTABLE MEDIUM IN A PRINTING SYSTEM

[75] Inventors: Kevin Lauren Cote, Durham; Richard Daniel Curley, Dover, both of N.H.

[73] Assignee: Heidelberger Druckmaschinen AG, Heidelberg, Germany

[21] Appl. No.: 08/910,118

[22] Filed: Aug. 13, 1997

[51] Int. Cl.[7] ..... B26D 7/06

[52] U.S. Cl. ..... 83/23; 83/155; 83/155.1; 83/409.1

[58] Field of Search ..... 83/23, 109, 151, 83/155, 155.1, 409, 409.1, 409.2; 271/82, 187, 270

[56] References Cited

U.S. PATENT DOCUMENTS

| | | | |
|---|---|---|---|
| 1,356,900 | 10/1920 | Barber . | |
| 2,538,425 | 1/1951 | Nolan . | |
| 3,247,744 | 4/1966 | Huck et al. . | |
| 3,483,780 | 12/1969 | Hudson . | |
| 3,623,386 | 11/1971 | Bach et al. | 83/155 |
| 4,026,199 | 5/1977 | Adams et al. | 83/155.1 |
| 4,276,978 | 7/1981 | Deguchi et al. | 198/654 |
| 4,283,973 | 8/1981 | Spencer | 83/151 |
| 4,441,390 | 4/1984 | Hechler et al. | 83/154 |
| 4,905,986 | 3/1990 | Muller | 198/803.9 |
| 5,029,842 | 7/1991 | Belanger et al. | 83/155 |
| 5,289,768 | 3/1994 | Keller | 101/137 |
| 5,452,886 | 9/1995 | Cote et al. . | |
| 5,501,443 | 3/1996 | Cote et al. | 198/370.03 |
| 5,560,599 | 10/1996 | Curley et al. . | |
| 5,697,607 | 12/1997 | Pache | 271/204 |
| 5,865,082 | 2/1999 | Cote et al. . | |

FOREIGN PATENT DOCUMENTS 1 051 110 3/1952 Germany .

OTHER PUBLICATIONS

Browning Catalog No. 11, Eastern Bearings, Inc., Portsmouth, NH, 1991 (4 pages).

*Primary Examiner*—M. Rachuba

*Attorney, Agent, or Firm*—Burns, Doane, Swecker & Mathis, LLP

[57] ABSTRACT

The present invention is directed to a method and apparatus for providing positive control of a printable medium in a printing system such that high speed processing of the printable medium can be achieved without damage to the product (e.g., printed signatures). Exemplary embodiments are directed to a carrier system which contacts (e.g., grips) the printable medium from both sides to provide positive control over the printable medium as it is transported from one area of positive constraint (e.g., a folding mechanism of a folder device) to another area of positive constraint (e.g., transport tapes and/or a signature deceleration device located downstream of the cutting cylinders).

14 Claims, 6 Drawing Sheets

METHOD AND APPARATUS FOR PROVIDING POSITIVE CONTROL OF A PRINTABLE MEDIUM IN A PRINTING SYSTEM

BACKGROUND OF THE INVENTION

1. Field of the Invention

The present invention relates generally to printing systems. More particularly, the present invention relates to a carrier system for providing positive control over a printable medium being processed by a printing system, to prevent damage to the printable medium.

2. State of the Art

As processing speeds of printing systems continue to increase, their handling of the printable medium being processed becomes increasingly more difficult. For example, with respect to printing systems which are fed a web-like printable medium, desired processing speeds are approaching, and even exceeding, rates of three thousand feet per minute.

The processing of a web-like printable medium includes, for example, the cutting of the web-like printable medium along its feed direction into two or more continuous webs, or ribbons. Each of the ribbons is then separately processed to create sheet-like signatures by cutting each ribbon at regular intervals in a direction transverse to the feed direction. Each resulting signature incudes a leading edge and a trailing edge relative to the feed direction. Processing of the web-like printable medium can additionally include, for example, folding of the ribbon prior to its being cut into individual signatures.

To avoid damage to signatures produced by cutting the ribbon, it has been conventional to pin the ribbon to the cutting cylinder. This operation effectively constrains the leading edge of the ribbon to prevent its damage. For example, the ribbon is pinned onto cutting cylinders of a folding device used to fold and then cut the ribbon into signatures. However, this technique requires that the pinned leading edge of the ribbon be removed from each resultant signature in a post processing operation. Such a technique thus wastes the printable medium and involves additional processing. Accordingly, more recent developments in the handling of web-like printable mediums have been directed to the use of so-called pinless folders.

Pinless folders eliminate pinning of the ribbon to the cutting cylinder prior to transversely cutting the ribbon to separate the trailing edge of a downstream signature from the leading edge of the ribbon. However, pinless folders suffer an attendant loss in control over the ribbon's leading edge after the cutting process. This loss in control can result in downstream damage to the signatures. For example, the signatures can become bent at the corners of the leading edge. The use of pinless folders therefore limits the speed with which a printable medium can be processed. Accordingly, attempts to increase the processing speed of a printing system without damaging the signatures has resulted in efforts to regain control over the leading edge of the ribbon, without requiring a pinning of the leading edge to the cutting cylinder.

Two solutions used to address the foregoing problem are: (1) tacking of the ribbon's leading edge to the cutting cylinder via static electricity; and (2) corrugation of the ribbon as it is fed to the cutting cylinder. However, these solutions suffer attendant drawbacks. For example, the first solution involves electrically charging the ribbon so that static electricity can be used to hold the ribbon's leading edge to the cutting cylinder. However, where the ribbon has been folded prior to being cut into signatures, this electrical charging of the ribbon creates problems in post press processing where the folded signatures must be reopened. That is, the electrically charged, folded signatures resist opening during post press processing.

The second solution involves introducing corrugations to the ribbon to stiffen the ribbon for transport to the next area of constraint, such as a downstream signature deceleration device. However, the mechanical devices used to corrugate the ribbon are high wear devices, which are sensitive to adjust. As such, these devices are difficult to maintain, and require a high level of operator intervention.

In addition to the foregoing drawbacks, the use of techniques such as tacking and/or corrugation to control a ribbon's leading edge in a pinless folder is relatively ineffective at higher web speeds; for example, web speeds on the order of three thousand feet per minute or greater. In addition, these techniques become ineffective as the weight of the ribbons and/or signatures is reduced. As such these techniques have been deemed unreliable, even when used in combination.

Accordingly, it would be desirable to positively control a printable medium during its processing in a printing system, without suffering the drawbacks associated with conventional printing techniques.

SUMMARY OF THE INVENTION

The present invention is directed to a method and apparatus for providing positive control of a printable medium in a printing system such that high speed processing of the printable medium can be achieved without damage to the product (e.g., printed signatures). Exemplary embodiments are directed to a carrier system which contacts (e.g., grips) the printable medium from both sides to provide positive control over the printable medium as it is transported from one area of positive constraint (e.g., a folding mechanism of a folder device) to another area of positive constraint (e.g., transport tapes and/or a signature deceleration device located downstream of the cutting cylinders).

Generally speaking, exemplary embodiments relate to a method and system for providing positive (i.e., active) control over a printable medium being processed by a printing system, and include: means for contacting a printable medium from first and second sides of the printable medium; and means for driving the contacting means along a transport path of the printable medium in synchronism with the printable medium. In accordance with exemplary embodiments, the driving means can include a first roller chain carrier assembly located on a first side of the printable medium, and a second roller chain carrier assembly located on a second side of the printable medium. Each of the first and second roller chain carrier assemblies can include contacting means, such as crossbars. The crossbars of the first roller chain carrier assembly are driven in synchronism with the crossbars of the second roller chain carrier assembly, such that a crossbar from each of the first and second roller chain carrier assemblies constitute a crossbar pair. Each crossbar pair contacts the printable medium from opposite sides and, in conjunction with the roller chain carrier assemblies, guides the printable medium from one area of positive constraint to another.

BRIEF DESCRIPTION OF THE DRAWINGS

Other objects and advantages of the present invention will become more apparent to those skilled in the art from the following detailed description of preferred embodiments, when read in conjunction with the accompanying drawings, wherein.

DETAILED DESCRIPTION OF THE PREFERRED EMBODIMENTS

Figure 1:
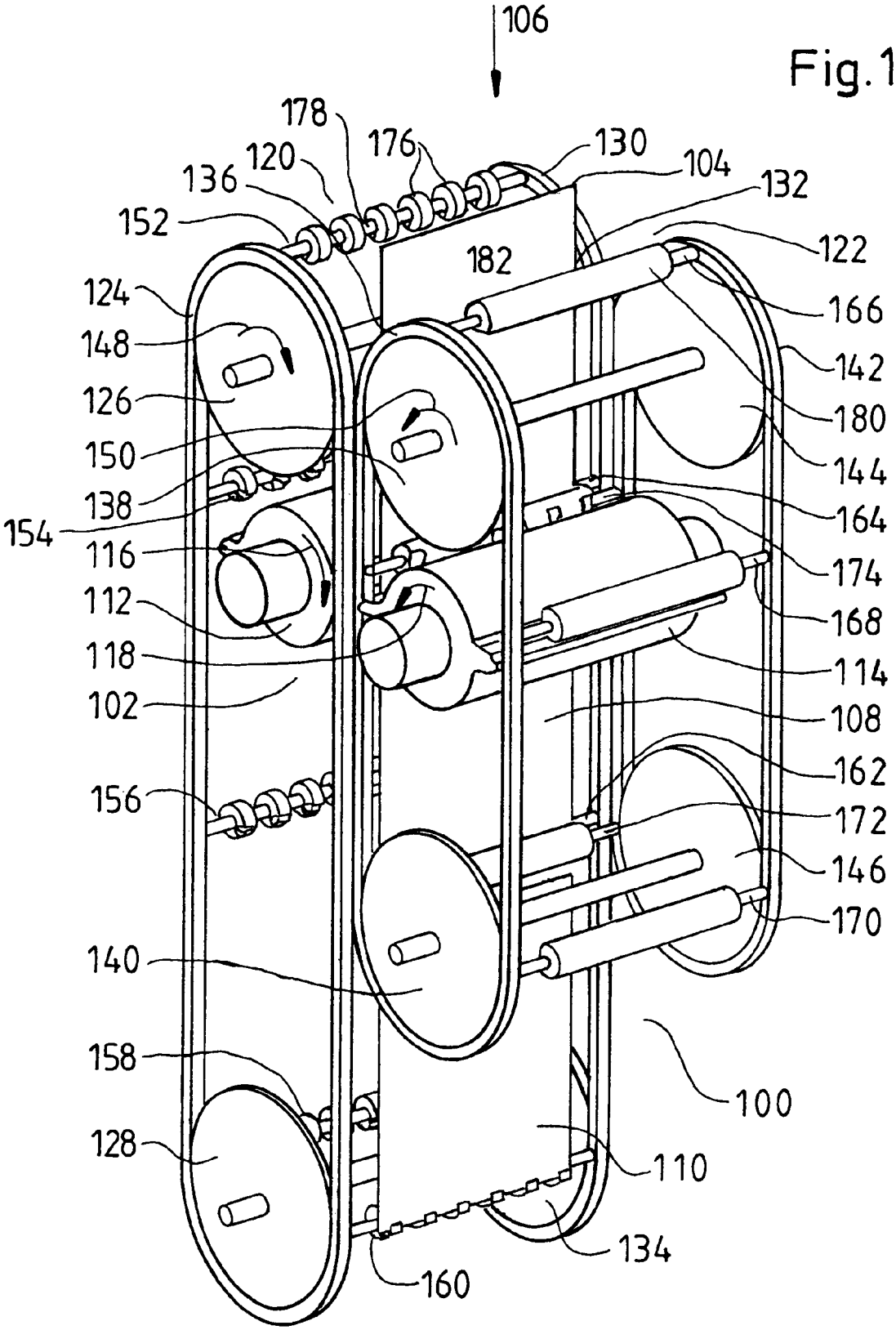
FIG. 1 is an illustration of an exemplary embodiment of the present invention.

FIG. 1 illustrates an exemplary carrier system 100 configured in accordance with the present invention. The FIG. 1 carrier system 100 is illustrated in conjunction with a modified cutting cylinder pair 102. The carrier system 100 transports a printable medium, such as a ribbon 104, from an earlier area of constraint (e.g., a folder mechanism of a pinless folder device) along a transport path 106 to the modified cutting cylinder pair 102. The exemplary carrier system 100, in addition to transporting a leading edge of the ribbon past the modified cutting cylinder pair 102, also transports the cut signatures from the cutting cylinder pair to a next area of constraint, such as a downstream transport device (for example, a signature deceleration device which, for the sake of clarity, is not illustrated in FIG. 1).

The modified cutting cylinder pair 102 cuts a trailing edge of a downstream signature 108 from the ribbon, and in so doing, establishes the leading edge of an upstream signature. FIG. 1 illustrates the cutting cylinder pair 102 in the process of cutting a trailing edge of the second signature 108. In the exemplary FIG. 1 embodiment, a downstream signature 110 which was previously produced is also illustrated.

In the FIG. 1 embodiment, the modified cutting cylinder pair 102 includes a modified knife cylinder 112. Further, the cutting cylinder pair includes an anvil cylinder 114 which has been modified in accordance with an exemplary embodiment of the present invention. Modifications to the knife cylinder 112 and to the anvil cylinder 114 include a configuration of each cylinder's periphery to allow features of the carrier system 100 to pass between the cutting cylinder pair, and thereby maintain positive control over the ribbon and signatures produced therefrom during the cutting operation. For the sake of simplicity, supports for the knife cylinder 112 and anvil cylinder 114 are not illustrated in FIG. 1. However, those skilled in the art will appreciate that these cylinders can be supported in any known fashion, and that it is the configuration of these cylinders, and their interrelationship with the carrier system 100, which constitutes a portion of the exemplary embodiment of the invention.

The carrier system 100 as illustrated in the exemplary FIG. 1 embodiment includes a first roller chain carrier assembly 120 for contacting the printable medium from one side, and a second roller chain carrier assembly 122 for contacting the printable medium from an opposite side. The first and second roller chain carrier assemblies work in synchronism to positively control a transport of the ribbon 104 from an area of constraint upstream of the cutting cylinder pair 102, through the cutting cylinder pair where signatures are formed. The first and second roller chain carrier assemblies maintain positive control over the signatures as they are transported to a downstream area of constraint.

As illustrated in FIG. 1, the first roller chain carrier assembly 120 includes a first looped drive chain 124 which is driven about a first gear (such as a sprocket) 126, and a second gear 128. The first roller chain carrier assembly 120 further includes a second looped drive chain 130 which is driven about a first gear 132 and a second gear 134.

The second roller chain carrier assembly 122 includes a first looped drive chain 136 driven about first and second gears 138 and 140. As with the first roller chain carrier assembly 120, the second roller chain carrier assembly 122 includes a second looped drive chain 142 driven about first and second gears 144 and 146, respectively.

The first and second looped drive chains 124 and 130 of the first roller chain carrier assembly 120 are driven in synchronism with one another in a first direction 148, while the first and second looped drive chains of the second roller chain carrier assembly are driven in synchronism with one another in a second direction 150. That is, the first and second gears of the first looped drive chain 124 are fixedly connected with the first and second gears of the second looped drive chain 130, respectively so that the first and second looped drive chains of the first roller chain carrier assembly rotate in synchronism. Similarly, the first and second gears of the first looped drive chain 136 are fixedly connected with the first and second gears of the second looped drive chain 142, respectively so that the first and second looped drive chains of the second roller chain carrier assembly rotate in synchronism.

The rotational directions 148 and 150 of the first and second roller chain carrier assemblies correspond to the directions 116 and 118 with which the modified knife cylinder 112 and the modified anvil cylinder 114 are driven, respectively. The drive systems used for the modified knife and anvil cylinders are conventional, and need not be described in greater detail, except to say that the ribbon can be transported in synchronism with the modified cutting cylinder pair, so that trailing edges of the signatures 108 and 110 can be cut at regular intervals to produce signatures of desired (e.g., constant) length. Those skilled in the art will further appreciate that the drive system for the cutting cylinders can be controlled in synchronism with a conventional drive of the first and second roller chain carrier assemblies using any conventional linkage (e.g., gear drive).

The first and second roller chain carrier assemblies 120 and 122 contact the ribbon 104 and signatures 108 and 110 of FIG. 1 via crossbars associated with each of the first and second roller chain carrier assemblies. More particularly, in the FIG. 1 embodiment, the first roller chain carrier assembly includes gripper crossbars 152 through 164. The second roller chain carrier assembly 122 includes roller crossbars 166 through 174.

The gripper crossbars of the first roller chain carrier assembly 120 rotate in synchronism with the roller crossbars of the second roller chain carrier assembly, such that as the ribbon 104 is transported along path 106 toward the modified cutting cylinder pair, a gripper crossbar (e.g., gripper crossbar 152) contacts the ribbon 104 from one side, while a corresponding roller crossbar (e.g., roller crossbar 166) contacts the ribbon from the other side. The gripper/roller crossbar pair then travels in a direction of the printable medium 104 along the transport path 106.

In accordance with exemplary embodiments of the present invention, the gripper/roller crossbar pairs (such as gripper crossbar 152 and roller crossbar 166) do not travel at the same speed the ribbon 104 travels. Rather, the gripper/roller crossbar pairs travel at a speed slightly greater than that of the ribbon 104 such that grippers 176 of the gripper crossbar 152 roll across a surface of the ribbon 104 as it is transported to a position downstream of the modified cutting cylinder pair.

In the exemplary FIG. 1 embodiment, each gripper crossbar is configured to include a plurality of the grippers 176 fixedly mounted on a support bar 178. For example, the FIG. 1 embodiment includes gripper crossbars wherein six such grippers are included on the support bar 178. In contrast, the roller crossbars, such as roller crossbar 166, each include a roller 180 supported on a support bar 182.

To provide for the accelerated rolling action of the gripper/roller pairs over the printable medium, each gripper and roller support bar is rotatably supported with respect to the first and second roller chain carrier assemblies. That is, each gripper support bar 178 and each roller support bar 182 in the FIG. 1. embodiment are rotatably supported by the first and second looped drive chains of the first and second roller chain carrier assemblies, respectively.

Figure 2:
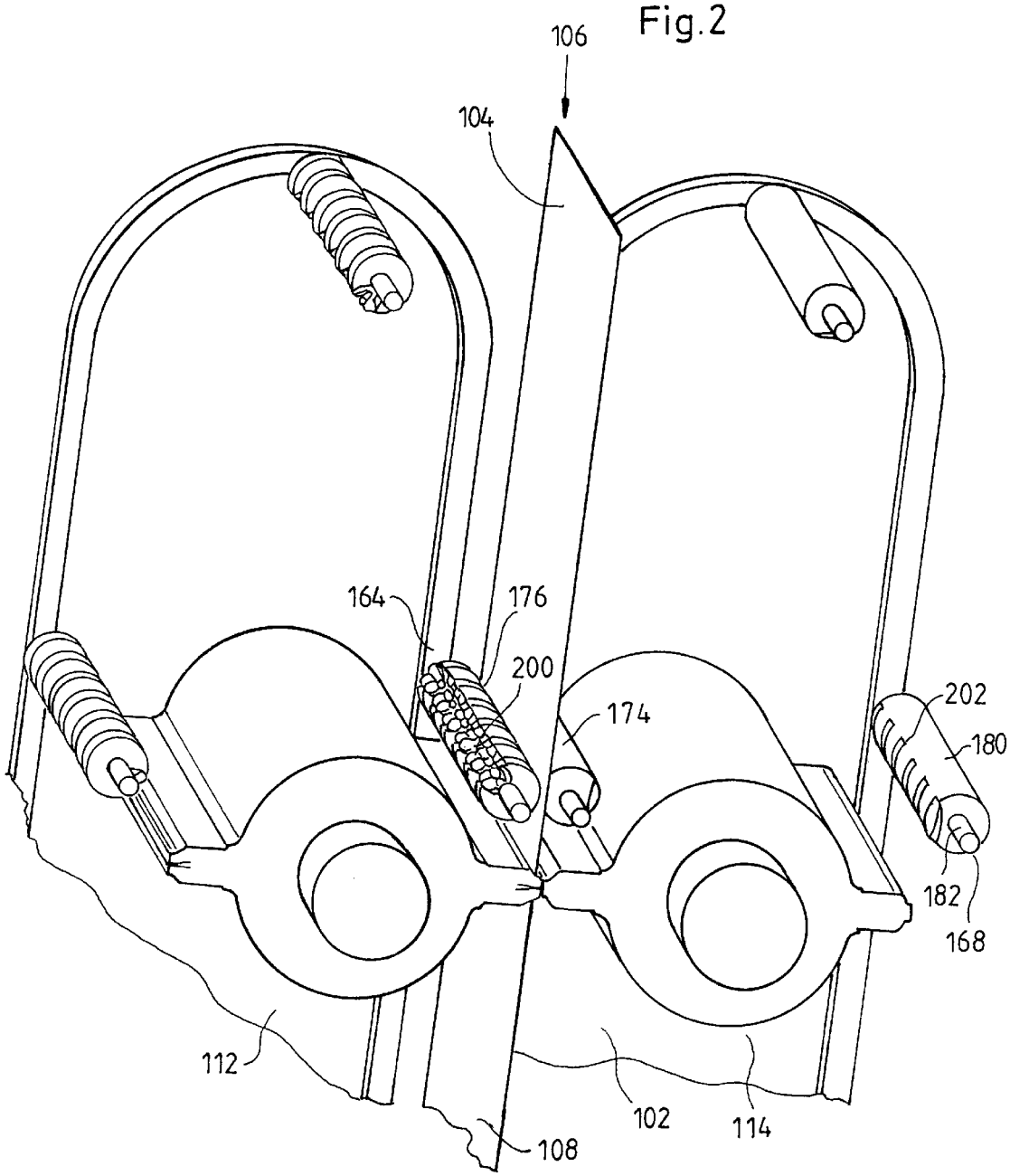
FIG. 2 shows features of the exemplary FIG. 1 embodiment in greater detail, at a point where a trailing edge of a signature is cut from a ribbon.

FIG. 2 illustrates a partial view of the carrier system 100 in conjunction with the modified cutting cylinder pair 102. In the exemplary FIG. 2 illustration, the peripheries of the knife cylinder 112 and anvil cylinder 114 have been configured to accommodate passage of the gripper and roller crossbars through the cutting cylinder pair 102. That is, peripheries of these cylinders have been reduced in diameter at all circumferential locations except where the two knives and the two anvils are located.

In FIG. 2, a gripper crossbar 164 and a corresponding roller crossbar 174 are illustrated at a position contacting the ribbon 104 just upstream from the cutting cylinder pair 102, at the instant which a knife and anvil of the cutting cylinder pair are cutting the trailing edge of downstream signature 108. Because the crossbars are transported along path 106 at a speed greater than that of the ribbon 104, the grippers 176 and rollers 180 of each crossbar pair rotate across the surface of the ribbon, and into a grip position located downstream of the cutting cylinder pair. In the grip position, a gripper finger 200 of each gripper 176 will have rotated into a position at which it grips the leading edge of the ribbon. The rollers 180 of each roller crossbar, such as roller crossbar 168, are configured with slots 202 that are configured to receive a respective gripper finger 200 at the grip position.

Figure 3:
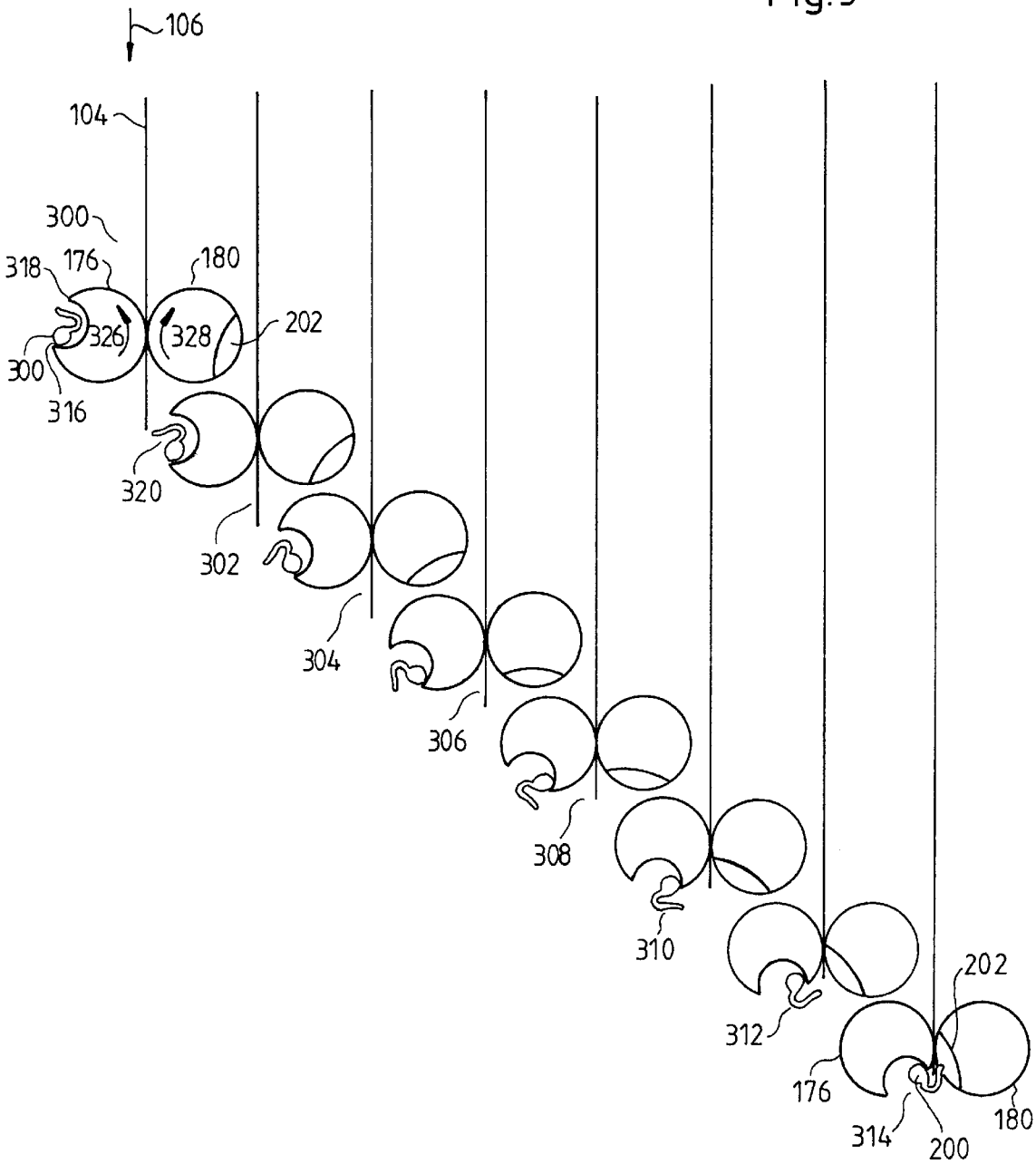
FIG. 3 shows an exemplary progression and rotation of crossbars included in the exemplary FIG. 1 embodiment as they travel along the transport path of a ribbon.

FIG. 3 shows the progression of a rotating gripper 176, and its associated gripper finger 200, as it travels both longitudinally in the direction 106, and rotationally across the ribbon surface. FIG. 3 further shows the interaction of the gripper 176 with an associated roller 180 having a slot 202. In the FIG. 3 exemplary embodiment, the gripper finger 200 is configured using a spring-like material that is pivotally mounted at a pivot point 316. In operation, the gripper finger remains within a slot 318 of the gripper 176 until inertia established by rotation of the gripper, coupled with gravity, causes the gripper finger to emerge from the slot and into a grip position. The gripper finger is shaped with an opening 320 that is configured to grasp an edge of the printable medium in the grip position. Upon reverse rotation of the gripper 176, the gripper finger releases the edge of the printable medium and pivots back into slot 318.

In a first stage of the FIG. 3 diagram labelled 300, the gripper finger 200 is located upstream of the cutting cylinder pair 102 (i.e., the cutting cylinder pair would be located in the lower half of the FIG. 3 diagram). In the first stage 300, the first and second roller chain carrier assemblies 120 and 122 of FIG. 1 have rotated such that the gripper 176 and roller 180 have been brought into contact with the ribbon 104. Once in contact with the ribbon, the gripper 176 and associated roller 180 collectively travel longitudinally along the transport path 106 at a speed which is greater than that with which the ribbon 104 is transported. As such, the gripper 176 and roller 180 rotate relative to the ribbon in directions indicated by arrows 326 and 328, respectively. The exemplary location of the gripper 176 and roller 180 in the first stage 300, for purposes of this discussion, can be considered to have occurred at the instant the downstream cutting cylinder pair have cut the trailing edge of a signature which has just been processed (that is, the position of gripper crossbar 164 and roller crossbar 174 in FIG. 2). Thus, the gripper 176 and roller 180 positively contact the ribbon 104 prior to the time a cutting operation is performed.

In a second stage 302 of the FIG. 3 progression, the gripper 176 and roller 180 have travelled longitudinally along the transport path at a speed greater than that of the ribbon 104. In addition, due to their increased speed relative to the ribbon's speed, they have also rotated relative to the ribbon. For example, compare exemplary locations of the gripper finger 200 and slot 202 in the second stage 302 with their locations in first stage 300.

The accelerated speed of the gripper and roller crossbars is illustrated in the FIG. 3 progression by indicating that these elements catch up to the leading edge of the signature currently being severed from the ribbon, so that this leading edge can be positively gripped by the time the trailing edge of that signature is severed from the ribbon in stage 314. That is, a rolling action of the grippers and rollers continues though a third stage 304, a fourth stage 306, a fifth stage 308, a sixth stage 310 and a seventh stage 312 of the FIG. 3 diagram, to a grip position represented by the eighth stage 314. In the eighth stage, the gripper finger 200 actually grasps a leading edge of a signature which is being severed from the ribbon 104. In addition, the slot 202 of the roller bar 180 has rotated in synchronism with the gripper 176 to a location at which the slot receives the gripper finger 202 in the grip position.

The rolling action of the grippers and rollers along the ribbon 104 at a speed greater than that with which the ribbon is transported, irons out any ripples (e.g., dog ears) which could form on the printable medium as it is transported. Further, to the extent any damage had previously occurred to the ribbon and/or signatures, the accelerated speed with which the gripper and roller pairs pass over the printable medium corrects for damage which may have occurred upstream of the carrier system. The accelerated speed of the gripper/roller pairs permits the gripper fingers 200 and slots 202 to be rotated into the grip location of the eighth stage 314, where they grasp a leading edge of the printable medium at a location downstream of the cutting cylinder pair. In addition, the accelerated speed of the gripper/roller pairs prevents them from skidding across the ribbon, and thereby prevents damage which could be caused by such skidding.

Figure 4:
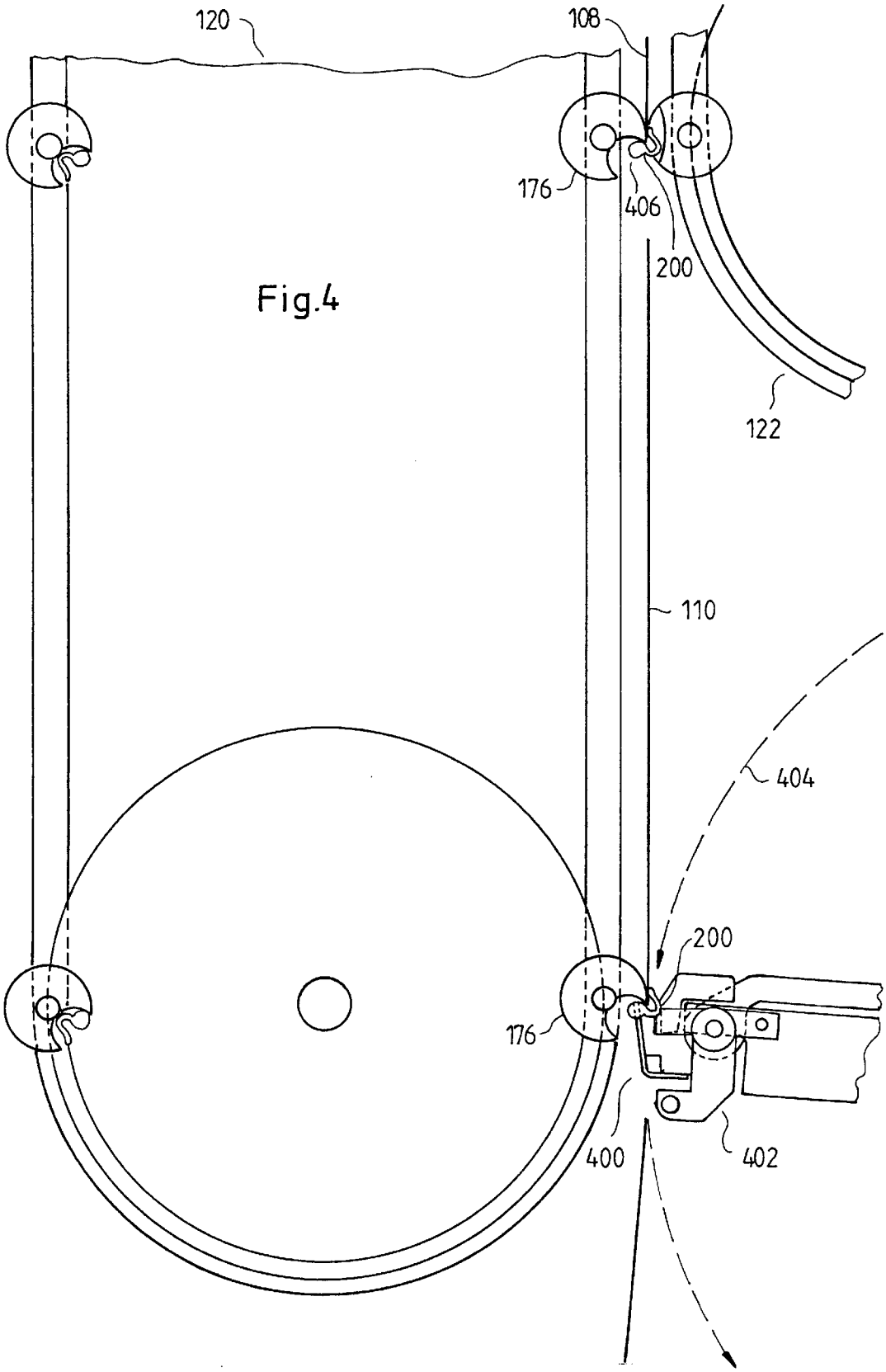
FIG. 4 illustrates a transport of a signature according to the exemplary FIG. 1 embodiment in greater detail.

FIG. 4 illustrates a leading edge of a signature 108 whose trailing edge is in the process of being cut by the upstream cutting cylinder pair. Further, FIG. 4 illustrates a signature 110 immediately prior to a release of its leading edge into a downstream area of constraint, such as a downstream deceleration device 402.

In the FIG. 4 illustration, a gripper 176 is illustrated at a location 400 where the gripper finger 200 is set to release the leading edge of the signature 110 to the deceleration device 402. In FIG. 4, once the gripper 176 releases the leading edge, it is grasped by the downstream deceleration device 402, such as by the gripper arm of a deceleration drum described in commonly assigned U.S. Pat. Nos. 5,452,886 and 5,560,599. These patents are directed to positive control deceleration drums used to reduce the transport speed of the cut signatures for downstream processing, and these patents are hereby incorporated by reference in their entireties.

In the FIG. 4 illustration, the first roller chain carrier assembly 120 is illustrated as extending in a vertical direction of the Figure below the second roller chain carrier assembly 122. In the exemplary embodiment illustrated, this discrepancy in the length of the two roller chain carrier assemblies is provided to accommodate for the deceleration device 402, which rotates along the dashed path 404.

As those skilled in the art will appreciate, the transport speed associated with the first roller chain carrier assembly is synchronized with a speed of the deceleration device 402 at the point the gripper finger 200 releases the leading edge to the deceleration device 402 at location 400. The deceleration device 402 then decelerates the speed with which the signature is transported in known fashion.

In the FIG. 4 illustration, an upstream location 406 is shown with respect to a leading edge of signature 108. At the upstream location 406, a gripper finger 200 of a gripper 176 has rotated along a surface of a ribbon to the grip position, where it has gripped a leading edge of the ribbon at a point in time which corresponds approximately to the severing of the trailing edge associated with signature 108. This gripping of the leading edge by the gripping finger 200 in FIG. 4 corresponds to the stage 314 of FIG. 3. The gripper finger 200 maintains a positive grip on the leading edge of the severed signature 108 to transport the signature to the downstream location 400 where the signature is released to the deceleration device 402.

Having described a general configuration of a carrier system for providing positive control during transport of a ribbon and/or signatures cut therefrom, a more detailed discussion will now be provided of an exemplary manner by which the gripper fingers 200 and slots 202 are driven so as to grip a leading edge of a ribbon, and then subsequently open to release the leading edge of the signature to a positive control device, such as deceleration device 402.

Figure 5:
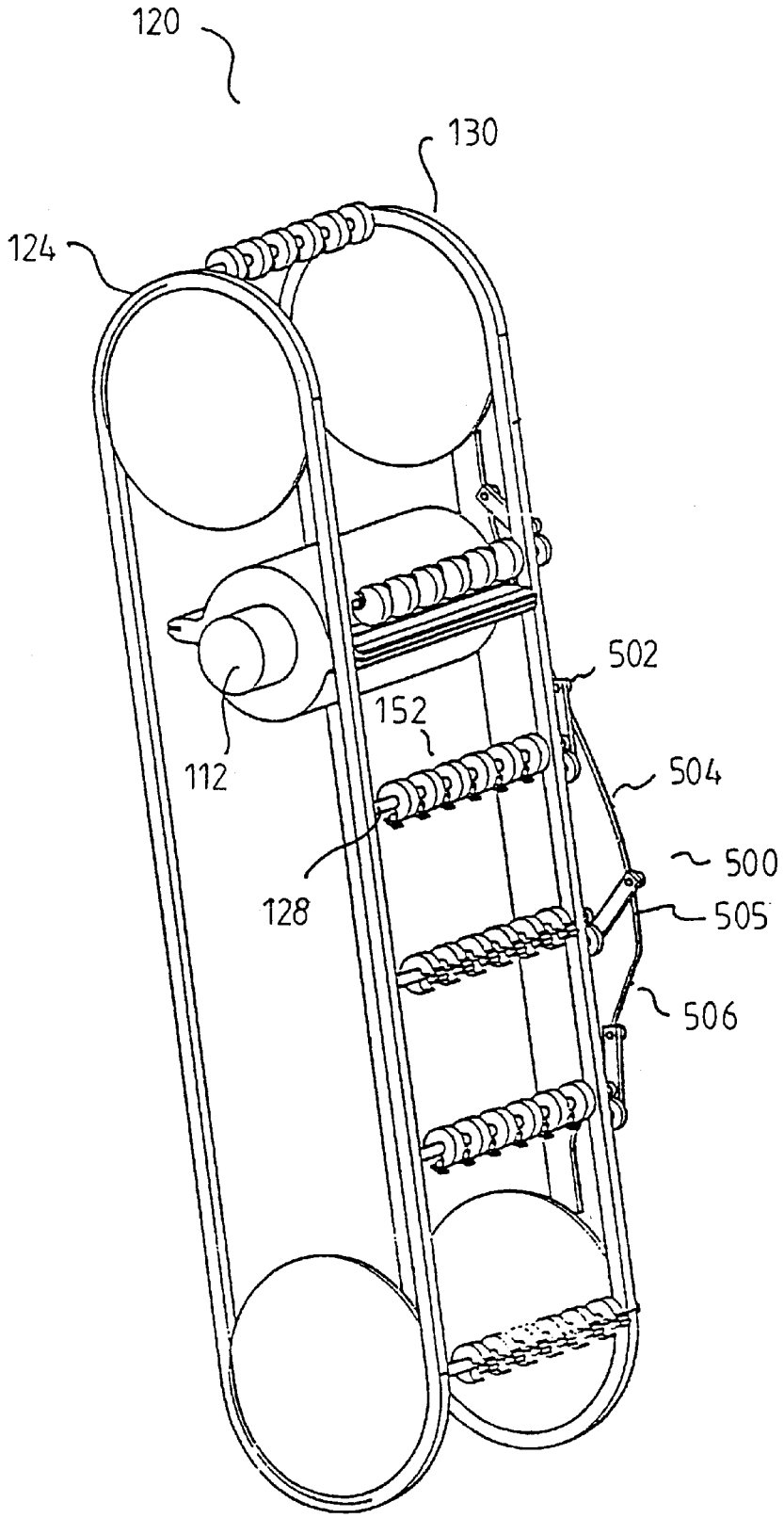
FIG. 5 illustrates an exemplary manner by which crossbars of the exemplary FIG. 1 and FIG. 3 embodiment are rotated using a cam device.

Referring, to FIG. 5, rotation of the gripper crossbars and the associated roller crossbars is illustrated. To accommodate rotation of the gripper and roller support bars 178 and 182, opposite ends of the support bars are rotatably mounted. For example, the support bars of the grippers and rollers are rotatably mounted in blocks attached to the first and second looped drive chains. Any conventional connecting mechanism can be used to attach a rotatable support bar to the chained carrier assemblies, including attachments available from Browning Manufacturing Inc. of Maysville, Ky., as described in their 1991 catalog No. 11.

Rotation of the gripper and roller crossbars relative to the printable medium is achieved using a cam device. For example, rotation of the grippers relative to the printable medium is controlled by a cam 500 of the first roller chain carrier assembly 120. A similar cam is provided with respect to the second roller chain carrier assembly 122 of FIG. 1. However, to simplify the following discussion, only the first roller chain carrier assembly 120 and its associated cam are illustrated in FIG. 5.

Each of the gripper crossbars is rotated by the action of a cam follower 502 and an associated meshing gear arrangement which operates to rotate the support bar 178. The cam 500 includes multiple sections for rotating the grippers, each section being configured with a different cam profile. A first section 504 of the cam 500 rotates the support bar 178 and gripper fingers mounted thereon in a first rotational direction by a first angle of rotation (for example, 180 degrees) to the grip position where the gripper fingers grip a leading edge of the ribbon prior to a trailing edge of a signature being, severed from the ribbon. A second section 505 of the cam 500 retains the support bar 178 in a fixed rotational state where the grippers retain a grip on the leading edge of the ribbon. A third section 506 of the cam rotates the support bar 178 and the gripper fingers mounted thereon in a second direction, opposite the first direction, to release the leading edge of a cut signature.

Referring to the exemplary FIG. 5 embodiment, the first section 504 of the cam 500 has a ramped profile which causes the gripper fingers of each gripper crossbar to grip the leading edge of the ribbon. The second section 505 of the cam 500 has a relatively flat profile during which the gripper fingers retain a grasp on the leading edge. The third section 506 of the cam 500 has a ramped profile with a slope of opposite polarity as compared to the first section 504, to cause the gripper fingers of a given gripper crossbar to release the signature as the cam follower approaches the downstream deceleration device.

In FIG. 5, the support bar 178 of each gripper crossbar passes beyond the second looped drive chain 130 of the first roller chain carrier assembly 120 to interact with the cam device. The support bars 182 of the FIG. 1 roller crossbars are similarly configured.

Figure 6:
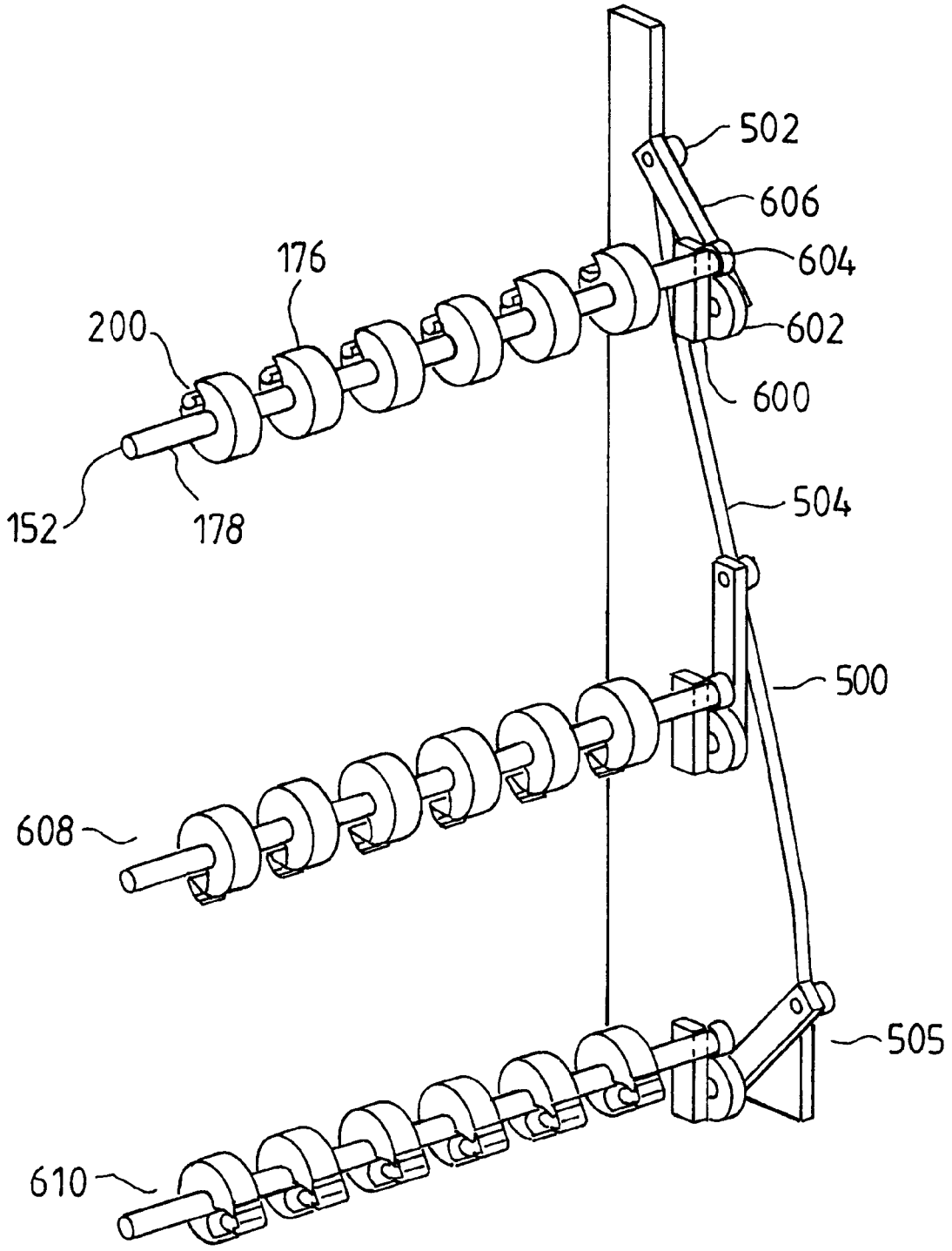
FIG. 6 illustrates a portion of the exemplary FIG. 5 cam device and a progression of a crossbar pair as it grips the printable medium.

FIG. 6 illustrates in greater detail the linkage between the cam follower 502 and the support bar 178 of a gripper crossbar for the first and second sections 504 and 505 of the cam 500. As shown in FIG. 6, the support bar 178 extends beyond the second looped drive chain 130 (which is not shown in FIG. 6 for sake of clarity), and through a block 600 which is attached to chained links of the second looped drive chain 130 in conventional fashion using, for example, a connector available from Browning Manufacturing Inc.

The block 600 is configured in known fashion to provide rotatable support of the support bar 178 and of a first cam gear 602. Those skilled in the art will appreciate that the support bar 178 rotates relative to the block 600 via any conventional bearing or pivoting means included within the block. A similar block-like connection can be used to rotatably mount the opposite end of the support arm 178 (that is, the end of support arm 178 which is located opposite the cam 500), to the first looped drive chain 124 of the first roller chain carrier assembly 120 shown in FIG. 5. Those skilled in the art will appreciate that the shaft used to support the first cam gear 602 of FIG. 6 can be a small stub shaft or shoulder bolt rotatably mounted to the block 600 using any conventional connecting means, such as a bearing or other pivotal connection. A second cam gear 604 of FIG. 6 is provided at an end of the support bar 178 adjacent cam 500, and is fixedly attached thereto to rotate the support bar 178 in response to rotation of the first cam gear 602.

The first and second cam gears 602 and 604 are in a meshed arrangement, such that the second cam gear 604 will rotate with the first cam gear 602 by an amount of rotation that is dictated by the gear ratio between the teeth of these gears. The shaft used to rotatably support the first cam gear 602 with respect to block 600 is also used to fixedly mount a cam lever arm 606. The cam lever arm can, for example, be fixedly attached to the shaft of the first cam gear 602 in any conventional manner (e.g., bolting, welding and so forth).

As illustrated in the exemplary FIG. 6 embodiment, the cam lever arm 606 is configured to rotate the first cam gear 602 by 90 degrees as the cam follower 502 traverses the low dwell to high dwell profile of the first cam section 504. In the exemplary FIG. 6 embodiment, when viewed from the right hand side of the page, the second cam gear 604 rotates clockwise during movement of the cam follower along the first cam section 504, in response to the first cam gear 602 rotating counterclockwise during the first section 504 of the cam 500.

In an exemplary embodiment, the gear ratio is set such that a 90 degree rotation of the first cam gear 602 causes a 180 degree rotation of the second cam gear 604, and thus the gripper support bar 178. In FIG. 6, at a location 608, the second cam gear 604 and the gripper support bar 178 are shown to have rotated 90 degrees from their starting, point due to a 45 degree rotation of the first cam gear 602 and the cam lever arm 606 by the cam follower 502. The gripper support bar is then shown to have rotated to a grip position 610 in the lower portion of FIG. 6, wherein it has rotated 180 degrees from its starting point due to a 90 degree rotation of the first gear 602 and the cam lever arm 606.

As the cam follower 502 traverses the first cam section 504 from its low dwell to its high dwell, the gripper fingers 200 are thus caused to rotate with support bar 178 in a clockwise direction to the grip position. The roller crossbars of FIG. 1 are configured to operate using a similar cam device which causes their rotation in a clockwise direction that is synchronized with rotation of the gripper crossbars. This rotation of the gripper and roller crossbars continues to the high dwell of the FIG. 5 cam section 504.

Once the cam follower 502 reaches the relatively flat, second section 505 of the cam 500, further rotation of the gripper support bar 178 is discontinued, and support bar 178 is maintained in a fixed rotational position. Again, the roller support bars are operated in similar fashion.

During traversal of the third section by the cam follower 502, a reverse rotation of the gripper support bar 178, in a direction opposite the direction caused by the first cam section 504, will occur. A similar reverse rotation of an associated roller support bar occurs in synchronism with the reverse rotation of the gripper support bar. That is, rotational directions of the gripper and roller support bars is reversed as the cam followers traverse the high dwell area to the low dwell area of the third cam section 506. This reverse rotation of the support bars for the gripper/roller crossbar pair results in the gripper fingers opening to release a signature to the downstream area of constraint, such as the gripper arm of the deceleration drum.

Of course, those skilled in the art will appreciate that any number of cam designs can be used to achieve any desired effect (such as any desired degree of rotation), and the invention is not limited to the exact cam device illustrated in FIGS. 5 and 6. Those skilled in the art will also appreciate that the gear ratios selected between the first and second cam gears 602 and 604, as well as any other portion of the linkage, can be selected in any desired manner to achieve any desired degree of rotation of the support bars 178 and 182.

Those skilled in the art will further appreciate that although the cam 500 of FIG. 6 is shown on a right hand side of the first roller chain carrier assembly, the invention is not so limited. Rather, the cam can be included on either side of the first and second roller chain carrier assemblies. Further, those skilled in the art will appreciate that the grippers, rollers and crossbars, as well as any other components of the exemplary embodiments described herein can be configured using any conventional materials. For example, the rollers and grippers can be configured using material with a higher coefficient of friction, such as rubber or urethane. The gripper fingers can be configured as spring-like devices using spring steel, and the crossbars can be configured with steel shafts. Gears used in accordance with exemplary embodiments of the present invention can also be configured of any material including, but not limited to plastic, or any metal (e.g., bronze, steel and so forth). The cam level arms can be similarly configured of any readily available material. Further, any number of grippers or rollers can be included on the gripper and roller support bars, respectively.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalents thereof are intended to be embraced therein.

What is claimed:

1. Apparatus for providing positive control over a printable medium being processed by a web-fed printing system, said apparatus comprising:

means for contacting the printable medium from first and second sides of the printable medium along a transport path of the printable medium, before and after a point in the transport path at which the printable medium is severed in a direction transverse to the transport path, including at least one gripper crossbar having at least one device for gripping a severed edge of said printable medium, said at least one gripper crossbar being rotatably mounted to said first roller chain carrier assembly, and at least one roller crossbar for contacting said printable medium in synchronism with said at least one gripper crossbar, said at least one roller crossbar being rotatable mounted to said second roller chain carrier assembly; and means for driving the contacting means along the transport path in synchronism with the printable medium, including at least a first roller chain carrier assembly located on a first side of a transport path of the printable medium, a second roller chain carrier assembly located on a second side of said transport path, opposite said first side.

2. Apparatus according to claim 1, wherein said at least one gripping device further includes:

a spring-like gripper finger for grasping said severed edge of said printable medium.

3. Apparatus according to claim 2, wherein said driving means further includes:

a cam device for rotating said at least one gripper crossbar relative to said printable medium.

4. Apparatus according to claim 3, wherein said cam device rotates said at least one roller crossbar in synchronism with said at least one gripper crossbar, and said roller crossbar further includes:

at least one slot for receiving said spring-like gripper finger during rotation of said gripping device.

5. Apparatus according to claim 3, wherein said cam device further includes:

a first section for rotating said gripping device in a first direction;

a second section for retaining said gripping device in a fixed rotational state; and a third section for rotating said gripping device in a second direction, opposite said first direction.

6. Apparatus according to claim 3, wherein said driving means further includes:

means for operably linking said at least one gripper crossbar with said cam device to control rotation of said at least one gripping device relative to said printable medium.

7. Apparatus according to claim 6, wherein said linking means further includes:

at least one gear for rotatably driving said gripper crossbar;

a cam follower for rotatably contacting said cam device; and a cam lever arm for operably connecting said cam follower with said at least one gear.

8. Apparatus according to claim 7, wherein said at least one gear of said linking means further includes:

a first cam gear operably connected with said cam lever arm; and a second gear, in meshing arrangement with said first gear, and fixedly connected with said at least one gripper crossbar.

9. Apparatus according to claim 8, further including:

at least one cutting cylinder pair for severing said printable medium at the point in the transport path in a direction transverse to a feed direction of said printable medium, said cutting cylinder pair being configured to permit said at least one gripper crossbar and said at least one roller crossbar to pass between first and second cylinders of said cutting cylinder pair in synchronism with rotation of said first and second cylinders.

10. A method for providing positive control over a printable medium being processed by a printing system, said method comprising the steps of:

contacting a printable medium from first and second sides of the printable medium with a contacting means along a transport path of the printable medium, wherein the transport path passes through a cutting operation during which the printable medium is severed in a direction transverse to a feed direction of the printable medium; and driving the contacting means along the transport path in synchronism with the printable medium at a speed greater than that with which said printable medium is transported along said transport path.

11. A method for providing positive control over a printable medium being processed by a printing system, said method comprising the steps of:

contacting a printable medium, at a location upstream of the cutting operation, from first and second sides of the printable medium with a contacting means along a transport path of the printable medium, wherein the transport path passes through a cutting operation during which the printable medium is severed in a direction transverse to a feed direction of the printable medium;

driving the contacting means along the transport path in synchronism with the printable medium, at a speed greater than that with which said printable medium is transported along said transport path; and advancing said contacting means across a surface of said printable medium, during transport of said printable medium, to a location at which said contacting means grasps an edge of said printable medium which was cut during said cutting operation.

12. A method according to claim 11, wherein said step of contacting further includes a step of:

rotating at last one gripper crossbar having a spring-like gripper finger across a surface of said printable medium during transport of said printable medium.

13. A method according to claim 12, further including a step of:

driving said contacting means in synchronism with said cutting operation.

14. A method according to claim 13, wherein said step of contacting further includes steps of:

rotating said gripper crossbar in a first direction to grasp said cut edge of said printable medium; and rotating said gripper crossbar in a second direction, opposite said first direction, to release said cut edge of said printable medium.

* * * * *